US011291246B2

(12) United States Patent
Huang

(10) Patent No.: US 11,291,246 B2
(45) Date of Patent: Apr. 5, 2022

(54) ELECTRONIC CIGARETTE AND METHOD FOR UNLOCKING ELECTRONIC CIGARETTE

(71) Applicant: Shenzhen YouMe Information Technology Co., Ltd, Guangdong (CN)

(72) Inventor: Furong Huang, Guangdong (CN)

(73) Assignee: Shenzhen YouMe Information Technology Co., Ltd, Shenzhen (CN)

( * ) Notice: Subject to any disclaimer, the term of this patent is extended or adjusted under 35 U.S.C. 154(b) by 526 days.

(21) Appl. No.: 16/310,814

(22) PCT Filed: May 30, 2018

(86) PCT No.: PCT/CN2018/089102
§ 371 (c)(1),
(2) Date: Dec. 17, 2018

(87) PCT Pub. No.: WO2019/184080
PCT Pub. Date: Oct. 3, 2019

(65) Prior Publication Data

US 2020/0138106 A1 May 7, 2020

(30) Foreign Application Priority Data

Mar. 30, 2018 (CN) ..... 201810286919.X

(51) Int. Cl.
*A24F 40/40* (2020.01)
*A24F 40/51* (2020.01)
(Continued)

(52) U.S. Cl.
CPC ..... *A24F 40/40* (2020.01); *A24F 40/51* (2020.01); *A24F 40/53* (2020.01); *A24F 40/60* (2020.01); *G07C 9/00563* (2013.01); *A24F 40/49* (2020.01)

(58) Field of Classification Search
CPC ..... A24F 40/40; A24F 40/51; A24F 40/60
See application file for complete search history.

(56) References Cited

U.S. PATENT DOCUMENTS

2014/0246035 A1 9/2014 Minskoff et al.
2015/0196057 A1 7/2015 Wu
(Continued)

FOREIGN PATENT DOCUMENTS

CN 204946036 U 1/2016
CN 107080290 A 8/2017
CN 206923681 U 1/2018

OTHER PUBLICATIONS

Extended European Search Report of counterpart European Patent Application No. 18815924 dated Feb. 28, 2020.

*Primary Examiner* — Eric Yaary
*Assistant Examiner* — Jennifer A Kessie

(57) ABSTRACT

Disclosed is an electronic cigarette, which includes a base (1) defining a receiving space, and an atomizer (2) connected with the base (1), a power supply (3), a control device (4), and an information collecting device (5) are all located in the base (1), a locking device (6) is located between the atomizer (2) and the base (1). The information collecting device (5) is electronically connected with the control device (4) and configured to collect a verification signal and output the verification signal to the control device (4), the control device (4) is connected with the power supply (3) and the locking device (6), and is configured to drive the power supply (3) to start and drive the locking device (6) to unlock the atomizer (2) and the base (1). The present disclosure also provides a method for unlocking the electronic cigarette.

10 Claims, 4 Drawing Sheets

(51) Int. Cl.

| | |
|---|---|
| ***G07C 9/00*** | (2020.01) |
| ***A24F 40/53*** | (2020.01) |
| ***A24F 40/60*** | (2020.01) |
| ***A24F 40/49*** | (2020.01) |

(56) References Cited

U.S. PATENT DOCUMENTS

| | | | |
|---|---|---|---|
| 2016/0325055 | A1 | 11/2016 | Cameron |
| 2017/0150757 | A1 | 6/2017 | Worm et al. |

ELECTRONIC CIGARETTE AND METHOD FOR UNLOCKING ELECTRONIC CIGARETTE

CROSS-REFERENCE TO RELATED APPLICATIONS

The present application is the National Stage of International Application PCT/CN2018/089102, filed May 30, 2018, which claims the benefit of China Patent Application No. 201810286919.X, filed Mar. 30, 2018, with the State Intellectual Property Office and entitled "electronic cigarette and method for unlocking electronic cigarette", the entirety of which is hereby incorporated herein by reference.

FIELD

The disclosure generally relates to the technical field of electronic atomization, and more particularly relates to an electronic cigarette, and a method for unlocking the electronic cigarette.

BACKGROUND

With the development of modernization and the improvement of living standards, people now pay more and more attention to personal health. Most of the people have the habit of smoking, however, smoking is harmful to health.

In order to solve the problem that smokers can hardly give up smoking even though knowing that smoking is harmful to health, electronic cigarettes are developed. The electronic cigarette commonly includes a base having a receiving space, a power supply located in the receiving space, and an atomizer plugged in the base.

However, a traditional electronic cigarette has the atomizer of which being plug connected with the base, or spirally connected with the base, in which the atomizer is prone to be separated from the base, and would be eaten by mistake by children. In addition, when in use, the atomizer is also prone to be separated from the base by a misoperation of children.

SUMMARY

According to the exemplary embodiment of the present disclosure, an electronic cigarette is provided, the electronic cigarette includes a base defining a receiving space, and an atomizer connected with the base, the electronic cigarette further includes a power supply, located in the base, the power supply is configured to power the electronic cigarette; a locking device, located between the atomizer and the base, the locking device is configured to lock the atomizer and the base; a control device, located in the base and connected with the locking device and the locking device, the control device is configured to drive the electronic cigarette to start, and drive the locking device to unlock the atomizer and the base; and an information collecting device, located in the base and connected with the control device, the information collecting device is configured to collect a verification signal and then output the verification signal to the control device; the control device drives the electronic cigarette to start and drives the locking device to unlock the atomizer and the base based on the verification signal collected by the information collecting device.

The present disclosure also provides a method for unlocking the electronic cigarette, the method includes the following steps:

inputting a custom unlock password by user, acquiring a verification signal and outputting the verification signal to a control device by an information collecting device;

sending an unlock instruction to a locking device according to the received verification signal by the control device;

separating the atomizer from the base according to the received unlock instruction by the locking device; and after the atomizer being separated from the base, a first locking member removing to lock the atomizer with the base under an action of a reset device in a preset duration of several seconds.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To better illustrate the technical solutions that are reflected in various embodiments according to this disclosure or that are found in the prior art, the accompanying drawings intended for the description of the embodiments herein or for the prior art will now be briefly described, it is evident that the accompanying drawings listed in the following description show merely some embodiments according to this disclosure, and that those having ordinary skill in the art will be able to obtain other drawings based on the arrangements shown in these drawings without making inventive efforts, where in these drawings.

DETAILED DESCRIPTION

To facilitate an understanding of the disclosure, hereinbelow the disclosure will be described in more fully detail with reference to the accompanying drawings. Preferred embodiments of the disclosure are provided in the accompanying drawings. However, the disclosure may also be implemented in a number of different forms, and thus is not limited to the embodiments described herein. Rather, these embodiments are intended to allow a more thorough understanding of the disclosure.

It should be noted that, when a component is mentioned to be "fixed" on another component, it may be fixed directly on the another component, or there may be an intermediate component. Similarly, when a component is regarded as "connected" to another component, it may be connected directly to the another component, or there may be an intermediate component.

Unless otherwise defined, all technical and scientific terms used herein have the same meaning as commonly understood by those of ordinary skill in the art. Terms used in the specification of the disclosure are for purposes of illustrating specific embodiments, but should not be construed in a limiting sense.

Figure 1:
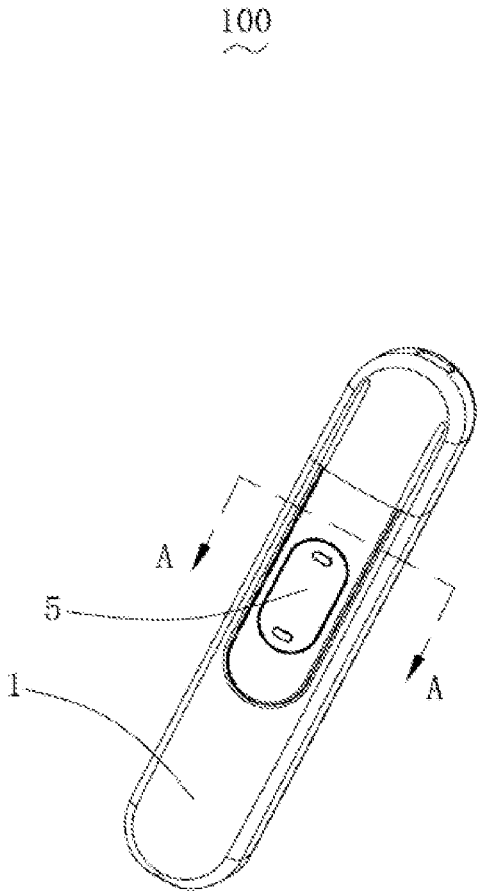
FIG. 1 is a structure diagram of the electronic cigarette according to an exemplary embodiment of the present disclosure.
Figure 2:
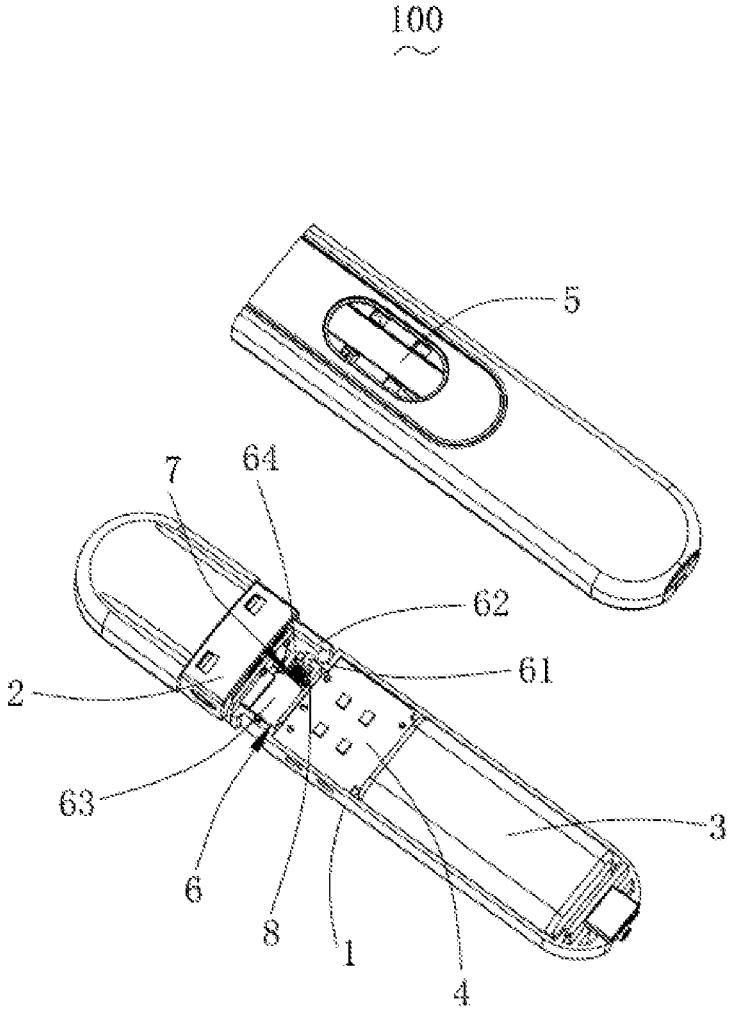
FIG. 2 is an exploded diagram of a part of the electronic cigarette shown in FIG. 1.
Figure 3:
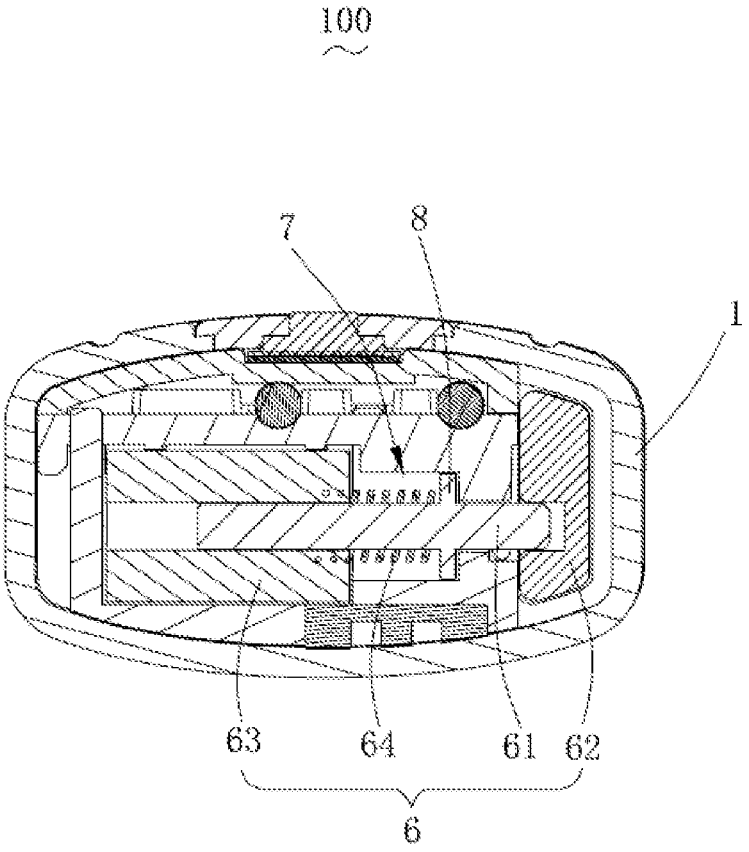
FIG. 3 is a cross section of the electronic cigarette along the line A-A shown in FIG. 1.

Referring to FIGS. 1-3, in an exemplary embodiment, the electronic cigarette 100 includes a base 1 defining a receiving space, an atomizer 2, a power supply 3, a control device 4, an information collecting device 5, and a locking device 6.

The base 1 defines a receiving space which is configured to mount the power supply 3, the control device 4, and the information collecting device 5, etc.

The atomizer 2 is connected with the base 1 through a plug connecting mode, or a spiral connection mode.

The power supply 3 is mounted in the receiving space of the base 1, the power supply 3 is configured to power the electronic cigarette 100, as such the electronic cigarette 100 can start to work. In detail, the power supply 3 can supply power to the atomizer 2, and the control device 3, etc.

The control device 4 and the information control device 5 are both mounted in the receiving space of the base 1.

The information collecting device 5 is connected with the control device 4, the information collecting device 5 is configured to collect a verification signal then output the verification signal to the control device 4, the information collecting device 5 can be electronically connected with the control device 4, or can be communicated with the control device 4. In the exemplary embodiment, the information collecting device 5 is a pressure detection unit, a capacitance detection unit, a photoelectric detection unit, a sound collection unit, a biometric information collection unit or an image recognition unit. Of course, the information collecting device includes at least two selected from a group consisting of a pressure detection unit, a capacitance detection unit, a photoelectric detection unit, a sound collection unit, a biometric information collection unit, and an image recognition unit, that is the at least two selected from the group can be combined with each other to form a coded lock. Of course, the coded lock can also be self-defined, and can be adjusted according to the requirement.

The locking device 6 is located between the atomizer 2 and the base 1, the locking device 6 is configured to lock the atomizer 2 with the base 1. In the exemplary embodiment, the control device 4 is electronically connected with the power supply 3 and the locking device 6, or can communicate with the power supply 3 and the locking device 6. The control device 4 is configured to drive the electronic cigarette 100 to start and drive the locking device 6 to unlock the atomizer 2 and the base 1. Preferably, the unlock mode of the locking device 6 can be custom unlock password, user can enters the custom unlock password to unlock, and user can also self-define the unlock password. Of course, the present disclosure is not limited to this, other feasible unlock methods shall all fall in the scope of the application.

In detail, if the verification signal collected by the information collecting device 5 is correct, after the control unit receives the correct verification signal, the control unit sends out an enabled instruction to drive the electronic cigarette 100 to start, and simultaneously sends out an unlock instruction to the locking device 6 to drive the locking device 6 to unlock. Therefore, the electronic cigarette 100 of the present disclosure can make the atomizer 2 to be separated from the base 1 and can start the electronic cigarette 100 through the correct verification signal, which can effectively avoid a misoperation of pulling the atomizer 2 from the base 1 to ensure the electronic cigarette 100 can be used normally, and can also avoid the children eating due to the misoperation, therefore greatly improving the reliability and security of the electronic cigarette 100.

In detail, the locking device 6 includes a first locking member 61 located at the base 1, a second locking member 62 located at the atomizer 2 and configured to lock together with the first locking member 61, a drive device 63 configure to drive the first locking member 61 to move until separating from the second locking member 62 (that is unlocking), and a reset device 64 connected with the first locking member 61 and configured to drive the first locking member 61 to reset (that is the first locking member 61 locks with the second locking member 62 again). In the exemplary embodiment, the drive device 63 is an electromagnet, which is sleeved on the first locking member 61. While the first locking member 61 is made of a material which physically interacts with the drive device 63, or at least a part of the first locking member 61 physically interacts with the drive device 63.

It is to be understood that, the physically interaction in the exemplary embodiment refers to that the first locking member 61 can attract or repel the drive device 63. Therefore, the first locking member 61 is made of a magnetic material, or at least a part of the first locking member 61 is made of a magnetic material. Of course, the first locking member 61 and the drive device 63 cooperatively form an electromagnetic drive structure, which can be manually or automatically controlled. In the exemplary embodiment, the reset device 64 is elastic medium. Such as, the elastic medium can be, but not limited to, a spring, a shrapnel, a silicone member, or a plastic member, etc.

Preferably, in the exemplary embodiment, a portion of the base 1 connected with the first locking member 61 defines a slide rail 7 and a limiting structure 8. The slide rail 7 is configured to support the first locking member 61, as such the first locking member 61 can move on the slide rail 7, therefore improving the reliability and sensitivity of the first locking member 61. The limiting structure 8 is fixed at one end of the first locking member 61 adjacent to the second locking member 62, the limiting structure 8 is configured to limit the reset position of the first locking member 61, to prevent the first locking member 61 from knocking the second locking member 62 during the moving processing of the first locking member 61, or the locking device 6 may be out of operation.

Of course, when the atomizer 2 is separated from the base 1 under the control of the control device 4, the atomizer 2 should be locked with the base 1 again, therefore, after separating the atomizer 2 from the base 1 by the locking device 6, and then after a preset number of seconds, the first locking member 61 would active to lock the atomizer 2 with the base 1 under an action of the reset device 64.

Figure 4:
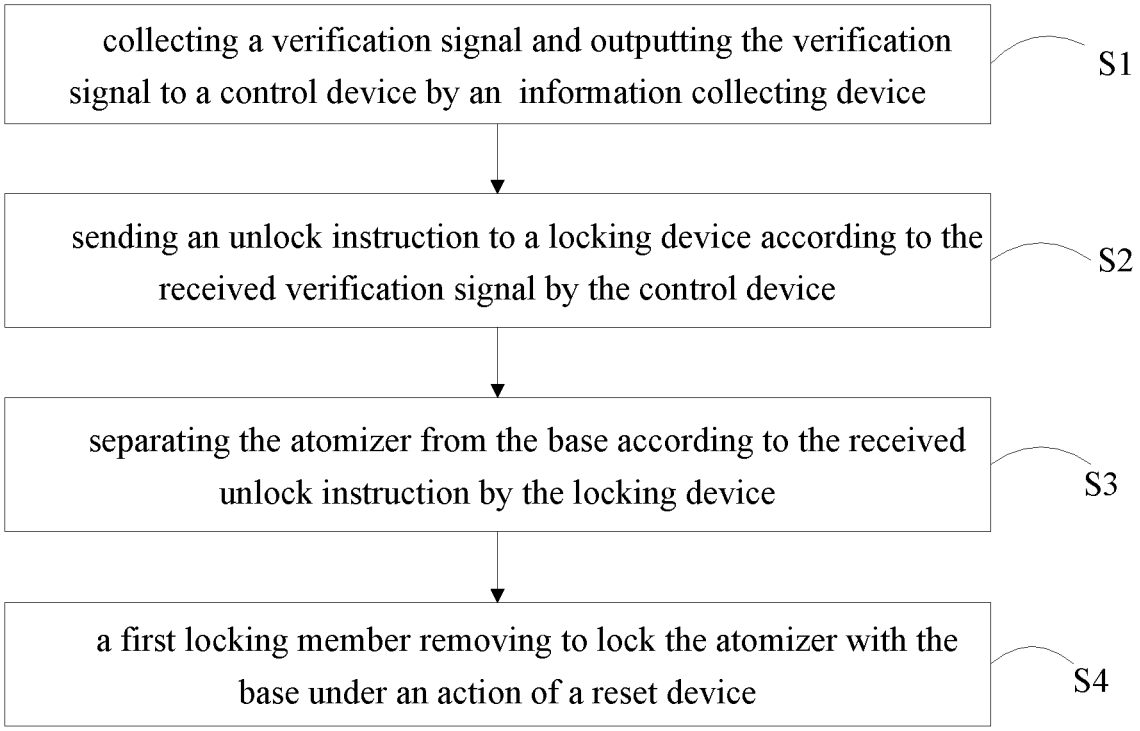
FIG. 4 is a flow chart of the method for unlocking an electronic cigarette according to an exemplary embodiment of the present disclosure.

Referring to FIGS. 2-4, the present disclosure also provides a method for unlocking the electronic cigarette, which includes the following steps:

S1, inputting a custom unlock password by user, acquiring a verification signal and outputting the verification signal to a control device 4 by an information collecting device 5;

The custom unlock password is just a preferable technical proposal, user can self-define the unlock password. For example, the combination padlock of the suitcase. In the exemplary embodiment of the present disclosure, the implementing scenario can be: long pressing a touch button for a few seconds, or inputting password, to enter into a custom mode, then user can set the password by pressing the touch buttons in an order. For example, if the electronic cigarette 100 includes three touch buttons, user can touch the touch buttons in different orders according to the requirement, the order of touching the touch buttons is defined as the custom unlock password. Of course, the present disclosure is not limited to this, other feasible unlock methods shall all fall in the scope of the application.

S2, sending an unlock instruction to a locking device 6 by the control device 4 according to the received verification signal;

S3, separating the atomizer 2 from the base 1 according to the received unlock instruction by the locking device 6; and S4, after the atomizer 2 is separated from the base 1, a first locking member 61 removing to lock the atomizer 2 with the base 1 under an action of a reset device 64 in a preset duration of several seconds.

Compared with the existing technology, the base of the electronic cigarette of the present disclosure is internally provided with the power supply, the control device, the information collecting device, and the locking defined between the atomizer and the base, as such the information collecting device is electronically connected with the control device, the information collecting device collects the verification signal and then transmits the verification signal to the control device, therefore, the control device drives the power supply to work and drive the locking device to unlock. The above structures can enable the locking device of the electronic cigarette need to verify the information of the operator through the information collecting device before perform the unlock operation, which can effectively avoid a misoperation of pulling the atomizer from the base to ensure the electronic cigarette can be used normally, and can also avoid the children eating due to the misoperation, therefore greatly improving the reliability and security of the electronic cigarette.

The above embodiments are merely several implementations of the disclosure, and are given a relatively specific and detailed description. However, the above embodiments shall not be construed to be limiting the patentable scope of the present disclosure. It should be noted that, those of ordinary skill in the art may also make a number of modifications and improvements without departing from the concepts of the present disclosure, all of which shall fall within the protection scope of the present disclosure. Hence, the protection scope of the present disclosure shall be best defined by the appended claims.

What is claimed is:

1. An electronic cigarette, comprising a base defining a receiving space, and an atomizer connected with the base, the electronic cigarette further comprising:

a power supply, located in the base, the power supply being configured to power the electronic cigarette;

a locking device, located between the atomizer and the base, the locking device being configured to lock the atomizer and the base;

a control device, located in the base and connected with the power supply and the locking device, the control device being configured to drive the electronic cigarette to start, and drive the locking device to unlock the atomizer and the base; and an information collecting device, located in the base and connected with the control device, the information collecting device being configured to collect a verification signal and then output the verification signal to the control device; wherein, the control device drives the electronic cigarette to start and drives the locking device to unlock the atomizer and the base based on the verification signal collected by the information collecting device;

wherein the locking device comprises a first locking member located at the base, a second locking member located at the atomizer and configured to lock with the first locking member, a drive device configured to drive the first locking member to move until separating from the second locking member, and a reset device connected with the first locking member and configured to drive the first locking member to reset.

2. The electronic cigarette according to claim 1, wherein the driving device is an electromagnet.

3. The electronic cigarette according to claim 2, wherein the first locking member is made of a material which physically interacts with the drive device, or at least a part of the first locking member physically interacts with the drive device.

4. The electronic cigarette according to claim 1, wherein the reset device is elastic medium.

5. The electronic cigarette according to claim 4, wherein the elastic medium is a spring, a shrapnel, a silicone member, or a plastic member.

6. The electronic cigarette according to claim 1, wherein a portion of the base connected with the first locking member defines a slide rail and a limiting structure.

7. The electronic cigarette according to claim 6, wherein the first locking member slides along the slide rail.

8. The electronic cigarette according to claim 6, wherein the limiting structure is connected with the first locking member, the limiting structure is configured to define a reset position of the first locking member.

9. The electronic cigarette according to claim 1, wherein the information collecting device is a pressure detection unit, a capacitance detection unit, a photoelectric detection unit, a sound collection unit, a biometric information collection unit, or an image recognition unit.

10. The electronic cigarette according to claim 1, wherein the information collecting device comprises a coded lock which is formed by combining at least two selected from a group consisting of a pressure detection unit, a capacitance detection unit, a photoelectric detection unit, a sound collection unit, a biometric information collection unit, and an image recognition unit.

* * * * *